US007803092B2

(12) United States Patent
Gilliam

(10) Patent No.: US 7,803,092 B2
(45) Date of Patent: Sep. 28, 2010

(54) FITNESS DEVELOPMENT SYSTEM HAVING AN EXERCISE CHAMBER WITH AN INCLINED FLOOR

(75) Inventor: Phillip Gilliam, 255 Susan La., Fayetteville, GA (US) 30215

(73) Assignee: Phillip Gilliam, Fayetteville, GA (US)

( * ) Notice: Subject to any disclaimer, the term of this patent is extended or adjusted under 35 U.S.C. 154(b) by 18 days.

(21) Appl. No.: 12/139,108

(22) Filed: Jun. 13, 2008

(65) Prior Publication Data

US 2009/0312159 A1 Dec. 17, 2009

(51) Int. Cl.
*A63B 21/00* (2006.01)
*A63B 26/00* (2006.01)
*A63B 23/00* (2006.01)

(52) U.S. Cl. ..... 482/92; 482/78; 482/132; 482/148

(58) Field of Classification Search ..... 482/35, 482/78, 92, 93, 148, 131, 132; 273/331, 273/335; 473/423, 432; 434/247, 255
See application file for complete search history.

(56) References Cited

U.S. PATENT DOCUMENTS 3,390,882 A * 7/1968 Megerle ..... 473/194
4,286,786 A * 9/1981 Papadopoulos ..... 473/432
4,615,528 A * 10/1986 York ..... 473/432
5,035,423 A * 7/1991 Arciniega ..... 473/433
5,042,820 A * 8/1991 Ford ..... 473/436
5,401,018 A * 3/1995 Kelly et al. ..... 473/430
5,492,319 A * 2/1996 Lee ..... 473/196
5,556,106 A * 9/1996 Jurcisin ..... 473/431
5,846,134 A * 12/1998 Latypov ..... 463/46
6,102,832 A * 8/2000 Tani ..... 482/4
6,149,152 A * 11/2000 Mancke ..... 273/123 R
6,563,489 B1 * 5/2003 Latypov et al. ..... 345/164
6,572,499 B2 * 6/2003 Davies ..... 473/604
6,740,009 B1 * 5/2004 Hall ..... 482/54
7,150,690 B1 * 12/2006 Cusick ..... 473/478
2004/0132362 A1 * 7/2004 Chiang et al. ..... 442/2

OTHER PUBLICATIONS http://images.google.com/imgres?imgurl=http://www.foundation news.org/files/1sisyphus.jpg&imgrefurl=http://www.foundation-news.org/CME/articles.cfm%3FI D%3D22%26IssueID%3D2134 &usg=__XcQEJamX8vX-jCJoWEBw35PNyQ8=&h=317&w=325 &sz=15&hl=en&start=35&um=1&itbs=1&tbnid=vfKUeg-RrEaLXM:&tbnh=115&tbnw=118&prev=/ images%3Fq%3Dcan%2527t%2Byou%2Bever%2Brelax%26start.*
http://www.cartoonstock.com/directory/t/thankless_task.asp.*
http://www.theraider.net/information/attractions/ epicstunts_photos.php.*
http://farm4.static.flickr.com/3558/3332502435_0fce3729dd.jpg.*

* cited by examiner

*Primary Examiner*—Loan Thanh
*Assistant Examiner*—Allana Lewin
(74) *Attorney, Agent, or Firm*—Dinsmore & Shohl LLP

(57) ABSTRACT

One embodiment relates to a fitness development system. The fitness development system generally comprises an exercise chamber and an object. The exercise chamber may comprise a base, an inclined floor, and one or more barriers. The base may define a substantially horizontal axis to support the exercise chamber, while the inclined floor may comprise an angle of inclination that defines a degree of separation of the inclined floor from the base, wherein the angle of inclination maximizes fitness development of an individual advancing the object up the inclined floor against a gravitational pull on the object. The barriers may substantially enclose the exercise chamber. The object may comprise a configuration enabling maximum fitness development of the individual advancing the object up the inclined floor.

18 Claims, 3 Drawing Sheets

FITNESS DEVELOPMENT SYSTEM HAVING AN EXERCISE CHAMBER WITH AN INCLINED FLOOR

TECHNICAL FIELD

Embodiments of the present invention generally relate to a fitness development system for promoting the physical fitness development of an individual. More particularly, embodiments relate to a fitness development system comprising an exercise chamber and an object, the exercise chamber comprising an inclined floor with an angle of inclination that maximizes fitness development of an individual advancing the object up the inclined floor against a gravitational pull on the object.

BACKGROUND

Exercise systems have been developed in various configurations that utilize level floors, weights, treadmills, and/or exercise machines, etc., to improve physical strength and/or stamina or to provide a cardiovascular workout. Such exercise systems, however, fail to assist in improving balance and center of gravity, while simultaneously improving strength and stamina and incorporating a cardiovascular workout. As such, there remains a need for a single, integrated exercise system that both promotes fitness development through upper and lower body strength and stamina training and improves the balance and center of gravity of the user while incorporating a cardiovascular exertion.

SUMMARY

To achieve the foregoing, one embodiment shown and described herein relates to a fitness development system. This fitness development system generally comprises an exercise chamber and an object. The exercise chamber may comprise a base, an inclined floor, and one or more barriers. The base may define a substantially horizontal axis to support the exercise chamber, while the inclined floor may comprise an angle of inclination that defines a degree of separation of the inclined floor from the base, wherein the angle of inclination maximizes fitness development of an individual advancing the object up the inclined floor against a gravitational pull on the object. The barriers may substantially enclose the exercise chamber. The object may comprise a configuration enabling maximum fitness development of the individual advancing the object up the inclined floor against a gravitational pull on the object.

To further achieve the foregoing, another embodiment shown and described herein relates to an exercise chamber. This exercise chamber generally comprises an inclined floor, a control unit, and one or more barriers. The inclined floor may be bidirectionally adjustable such that an angle of inclination of the inclined floor is bidirectionally adjustable from more than 0 degrees to less than 90 degrees, wherein the angle of inclination maximizes fitness development of an individual advancing an object up the inclined floor. The control unit may be operable to control bidirectional adjustment of the inclined floor while the barriers may substantially enclose the exercise chamber.

To further achieve the foregoing, another embodiment shown and described herein relates to a method of developing fitness of an individual. The method generally comprises advancing an object up an inclined floor against a gravitational pull on the object by pushing the object along the inclined floor with an upper body portion of the individual and by stepping along the inclined floor with a lower body portion of the individual. The inclined floor may comprise an angle of inclination that maximizes fitness development of the individual advancing the object up the inclined floor. The inclined floor may be bidirectionally adjustable such that the angle of inclination may be from more than 0 degrees to less than 90 degrees. Further, the inclined floor may be operably connected to a control unit operable to control bidirectional adjustment of the inclined floor. The advancing of the object up the inclined floor may develop fitness of both the upper and lower body portions of the individual.

BRIEF DESCRIPTION OF THE DRAWINGS

While the specification concludes with claims particularly pointing out and distinctly claiming embodiments, it is believed the same will be better understood from the following description taken in conjunction with the accompanying drawings in which:

DETAILED DESCRIPTION

Reference will now be made in detail to various embodiments that are illustrated in the accompanying drawings, wherein like numerals indicate similar elements throughout the views.

Figure 4:
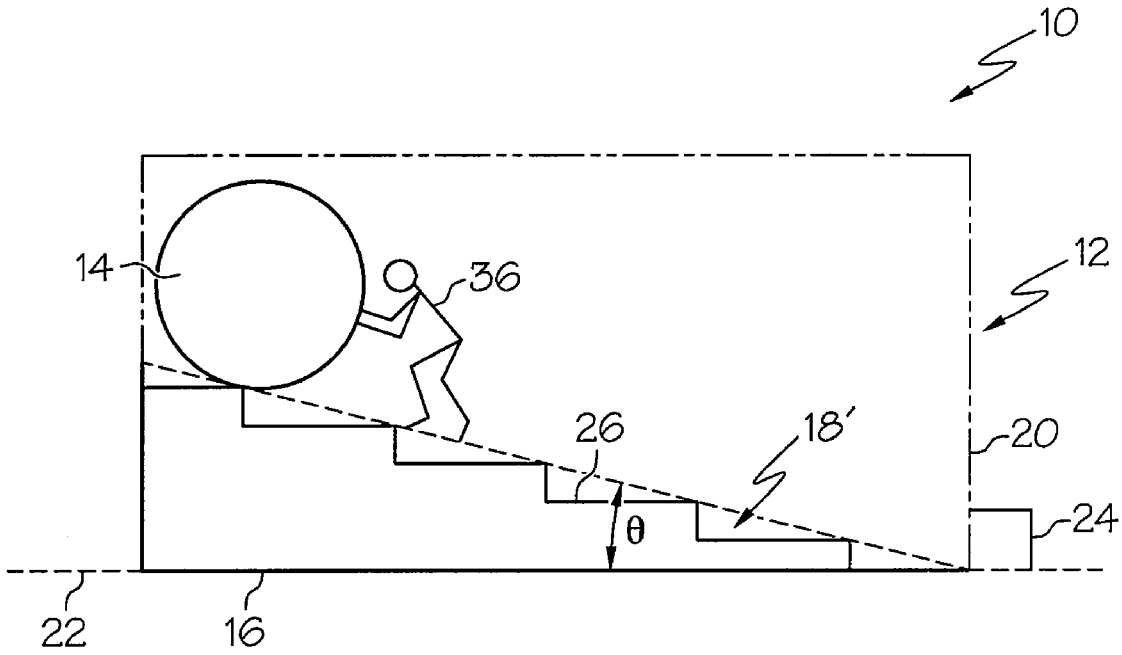
FIG. 4 is an illustration of a cross-sectional view of a fitness development system in accordance with yet another embodiment shown and described herein.

In accordance with various embodiments, a fitness development system may be configured to promote fitness development of an individual. Referring to the exemplary embodiments illustrated in FIGS. 1-4, the fitness development system 10 comprises an exercise chamber 12 and an object 14. The exercise chamber 12 generally comprises a base 16, an inclined floor 18, and one or more barriers 20. The base 16 may define a substantially horizontal axis 22 to support the exercise chamber 12. The inclined floor 18 may comprise an angle of inclination θ that defines a degree of separation of the inclined floor 18 from the base 16. As such, the inclined floor 18 generally provides a substantially planar surface that rises along the angle of inclination θ to a maximum height over the length of the exercise chamber 12. It is contemplated, however, that the inclined floor 18 may provide a sloped surface, a stepped surface 18' (illustrated in FIG. 4), or other profiled surface, or any combinations thereof, that rises along the angle of inclination θ.

Further, the angle of inclination θ may be optimized to maximize fitness development of an individual 36 advancing the object 14 up the inclined floor 18 against a gravitational pull on the object down the inclined floor 18. The angle of inclination θ may also be adjusted to suit the current fitness level of the individual. In one exemplary embodiment, the angle of inclination θ of the inclined floor 18 is about 14 degrees. In another exemplary embodiment, the angle of inclination θ is adjustable. In this embodiment, the exercise chamber 12 further comprises a control unit 24. The control unit 24 may be operable to control bidirectional adjustment (e.g. the control unit 24 is operable to raise and lower the inclined floor 18, thereby increasing or decreasing the angle of inclination θ) of the inclined floor 18 such that the angle of inclination θ is bidirectionally adjustable from more than 0 degrees to less than 90 degrees, with respect to the substantially horizontal axis 22 defined by the base 16 of the exercise chamber 12. The control unit 24 described herein is not limited to any particular configuration, but, rather, may be any device or system mechanically and/or electrically coupled to the inclined floor 18 and comprising the mechanisms and power necessary to control bidirectional adjustment of the inclined floor 18 so as to adjust the angle of inclination θ thereof. For example, the control unit 24 may be operably coupled to hydraulic pistons, pneumatic cylinders, mechanical gears, and/or the like that may be used in conjunction with the control unit 24 to raise or lower the inclined floor 18, thereby increasing or decreasing the angle of inclination θ.

Figure 2:
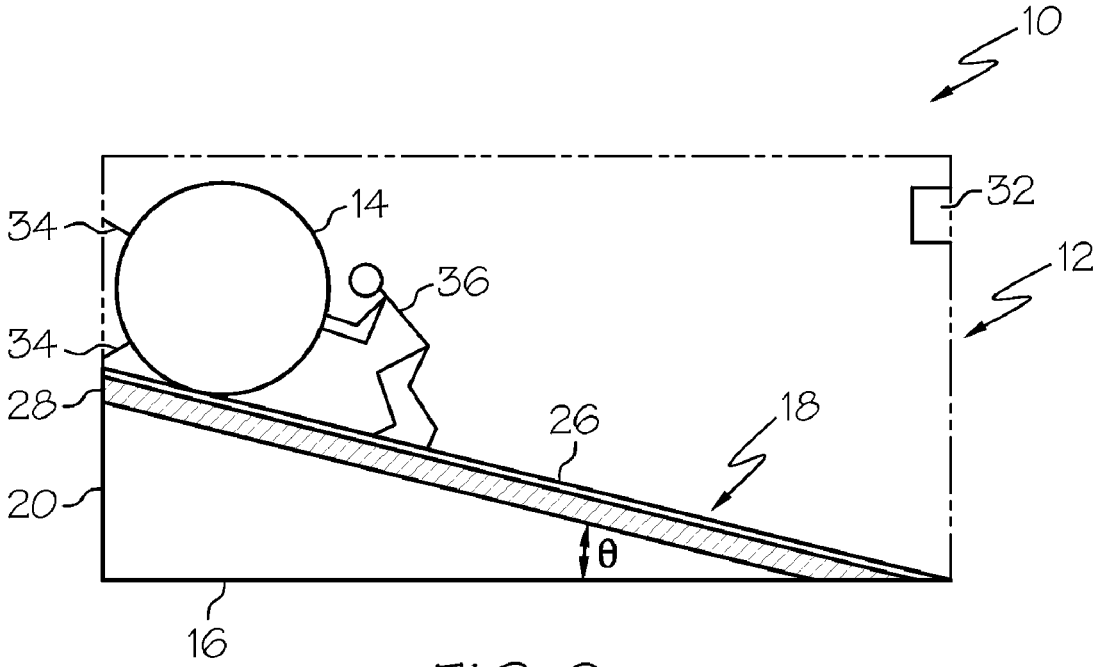
FIG. 2 is an illustration of a cross-sectional view of a fitness development system in accordance with another embodiment shown and described herein.
Figure 3:
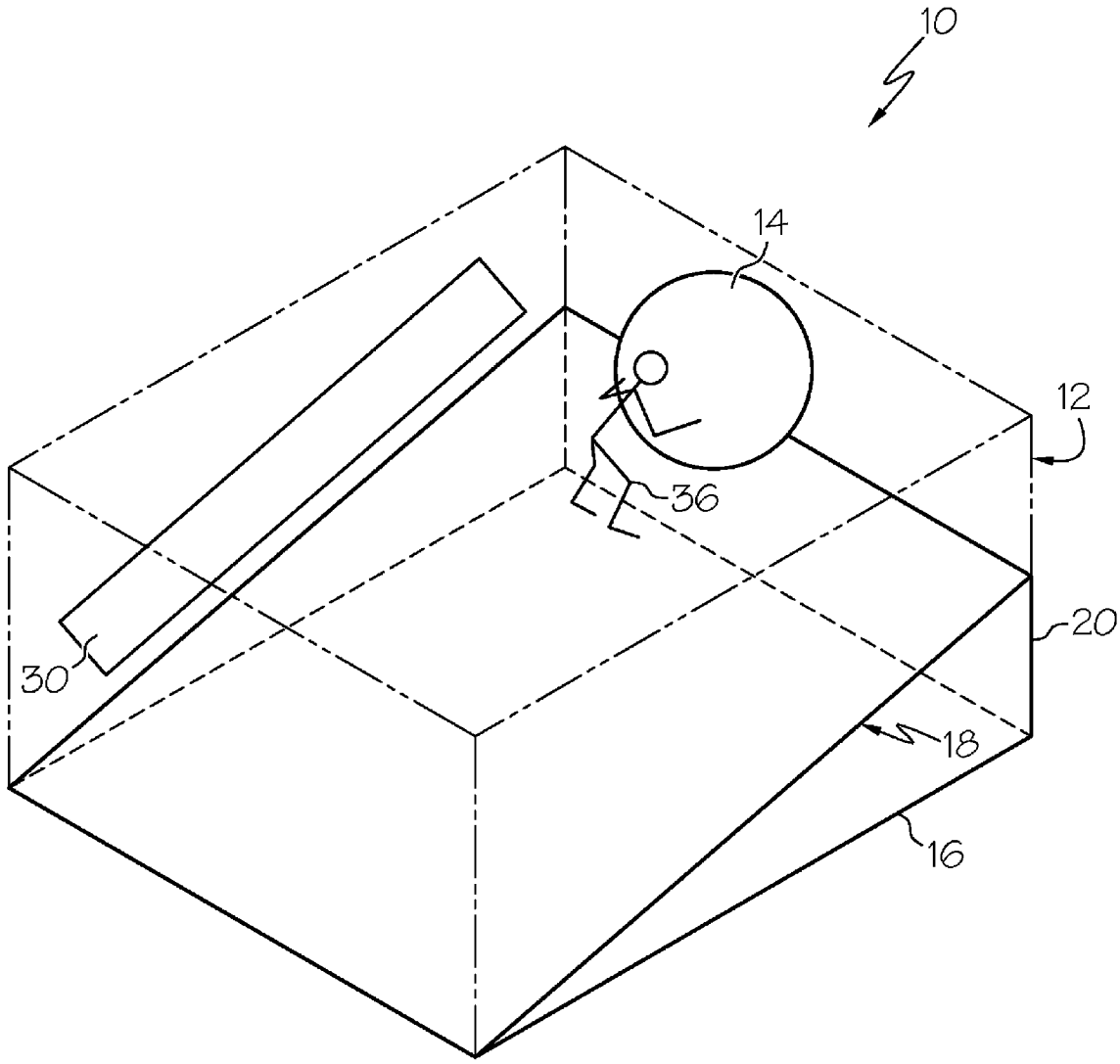
FIG. 3 is an illustration of a perspective view of a fitness development system in accordance with another embodiment shown and described herein.

The inclined floor 18 may also comprise a tactile surface 26 to improve traction and to reduce lost effort and exertion of the individual 36 that may be attributed to the individual 36 slipping while advancing the object up the inclined floor 18. As such, this tactile surface 26 may provide additional friction between the inclined floor 18 and the individual stepping thereon. For example, but not by way of limitation, a coefficient of friction between the tactile surface 26 and a foot or shoe of an individual stepping thereon may be from about 0.01 to about 0.99, or, more particularly, of from about 0.02 to about 0.50. In addition, the tactile surface 26 may have a thickness of about 0.50 inches and may provide impact absorption for the individual 36 stepping or crawling on the tactile surface 26. Alternatively, or in addition thereto, as shown in FIG. 2, the inclined floor 18 may also comprise a material 28 disposed between the tactile surface 26 and the inclined floor 18. This material 28 may provide impact absorption for the individual 36 using the exercise chamber 12.

The one or more barriers 20 substantially enclose the exercise chamber 12 to prevent the object 14 and/or the individual 36 from inadvertently falling from the inclined floor 18 of the exercise chamber 12. The barriers 20 may be walls, rails, fences, ropes, nets, etc., or any combinations thereof, capable of performing the functions described herein with respect to the barriers 20 of the exercise chamber 12.

The interior of the exercise chamber 12 defined by the barriers 20 generally is of a size sufficient to permit both lateral exertion and vertical exertion by the individual 36 in advancing the object 14 up the inclined floor 18. In one exemplary embodiment, shown in FIGS. 1-3, the exercise chamber 12 has four barriers 20 and is defined in a rectangular shape. By way of example, the height of the exercise chamber 12, as defined by the barriers 20, is about 10 feet, the length is about 20 feet, and the width is about 10 feet. As such, the chamber 12 may have a 1:2 height to length ratio and a 1:1 height to width ratio. Here, with an angle of inclination of about 14 degrees and a maximum height of about 5 feet, the length of the inclined floor 18 can be determined, through use of the Pythagorean Theorem ($A^2+B^2=C^2$), to be about 20.615 feet. By using the Pythagorean Theorem, various dimensions for exercise chambers 12 can be determined in order to provide rectangular exercise chambers 12 having different sizes and/or lengths or angles of inclination θ of the inclined floor 18. It is contemplated, however, that the exercise chamber 12 may be configured in one of any variety of shapes, such as, triangular, having three barriers 20, or circular, having only one barrier 20 about a circumference of the inclined floor 18. It is further contemplated that the exercise chamber 12 also may comprise a roof conjoined to the barriers 20 such that an interior of the exercise chamber 12 is substantially or entirely enclosed by the barriers 20 and the roof. Further, it is anticipated that at least one of the barriers 20 will offer ventilation and have one or more doors or entryways to permit entry and exit of the individual and the object 14 to and from the interior of the chamber 12. In addition, it is also contemplated that a series of interconnected or closely situated barriers 20 may define multiple exercise chambers 12 so as to create a complex of two or more fitness development systems 10 and/or exercise chambers 12.

In one exemplary embodiment, one or more of the barriers 20 of the exercise chamber 12 are padded with a material 30 so as to provide impact absorption for the individual 36 using the chamber 12. For example, with respect to a rectangular shaped exercise chamber 12, it is contemplated that just the side barriers may be padded, just the end barriers may be padded, or combinations thereof. Such material for padding may include, but is not limited to, foam, rubber, soft plastic, or other materials, and combinations thereof. In addition, one or more of the barriers 20 may be substantially entirely transparent to permit observation of an individual using the fitness development system 10 by others from outside of the chamber 12. The fitness development system 10 also may comprise a video-recording system 32 to record an individual 36 using the fitness development system 10 and/or an audio system to provide music or to communicate verbal instructions for the individual using the system 10. While the audio system generally is positioned at one or more locations in the interior of the chamber 12, the video-recording system 32 may be positioned at one or more locations in the interior of the chamber 12 or at one or more locations outside the chamber 12 with viewing access available through transparent barriers 20, or both. Such observation and recordation permit evaluation of the individual's practices and techniques in using the system 10 in order to provide recommendations for improvement to maximize fitness development.

As mentioned above, embodiments of the fitness development system 10 generally further comprise an object 14 that is to be advanced up the inclined floor 18 of the exercise chamber 12 against a gravitational pull on the object 14. The object 14 generally is advanced up the inclined floor 18 by the individual by rolling, but it is contemplated that the object may also be advanced by carrying, tossing, or otherwise moved up the inclined floor 18. The object 14 generally is spherical in shape, but, alternatively, may be cylindrical, elliptical, oblong, or faceted in shape, or provided in any shape capable of performing the functions described herein with respect to the object 14 of the fitness development system 10. It is contemplated that the individual 36 may switch from using an object 14 having one shape to another object 14 having a different shape so as to maximize fitness development. It is also contemplated that differently shaped objects 14 may provide variation in fitness development regimens and, as such, differently shaped objects may be utilized to enhance training of different conditions. By way of an exemplary comparison between a cylindrical object and a spherical object, an individual 36 may use a cylindrical object having a greater surface area in friction with the inclined floor 18 to enhance strength training or the individual may use a spherical object having less surface area in friction with the inclined floor, yet more laterally mobile, to enhance balance and center of gravity training.

The object 14 generally has a rigid exterior surface so that it does not collapse when pushed or grabbed by the individual 36. Further, the object 14 should be heavy enough to challenge the individual 36, but should not be so heavy as to make the advancement of the object 14 up the inclined floor 18 by the individual 36 too difficult to achieve. As such, the object 14 generally comprises a configuration, such as a diameter and a weight, enabling maximum fitness development of the individual 36.

Generally, the diameter of the object 14 is from about 3 feet to about 7 feet. In one exemplary embodiment, the weight of the object 14 is fixed at a predetermined amount. For example, but not by way of limitation, the object 14 may be a solid or substantially solid mass of material. The material may comprise rubber, polymer, metal, or rock, or combinations thereof. In one exemplary embodiment, the object 14 is a medicine ball. A number of differently weighted and/or sized medicine balls, or other objects, may be made available so as to provide variation to fitness development and to suit the needs or preferences of different individuals using the system 10. In another exemplary embodiment, the weight of the object 14 may be variable. For example, the object 14 may be at least partially and variably filled with water or another fluid. The fluid may be gas or liquid or combinations thereof. As such, the object 14 may be a ball or other similar object with a rigid exterior surface and one or more fillable or inflatable interior bladders.

Figure 1:
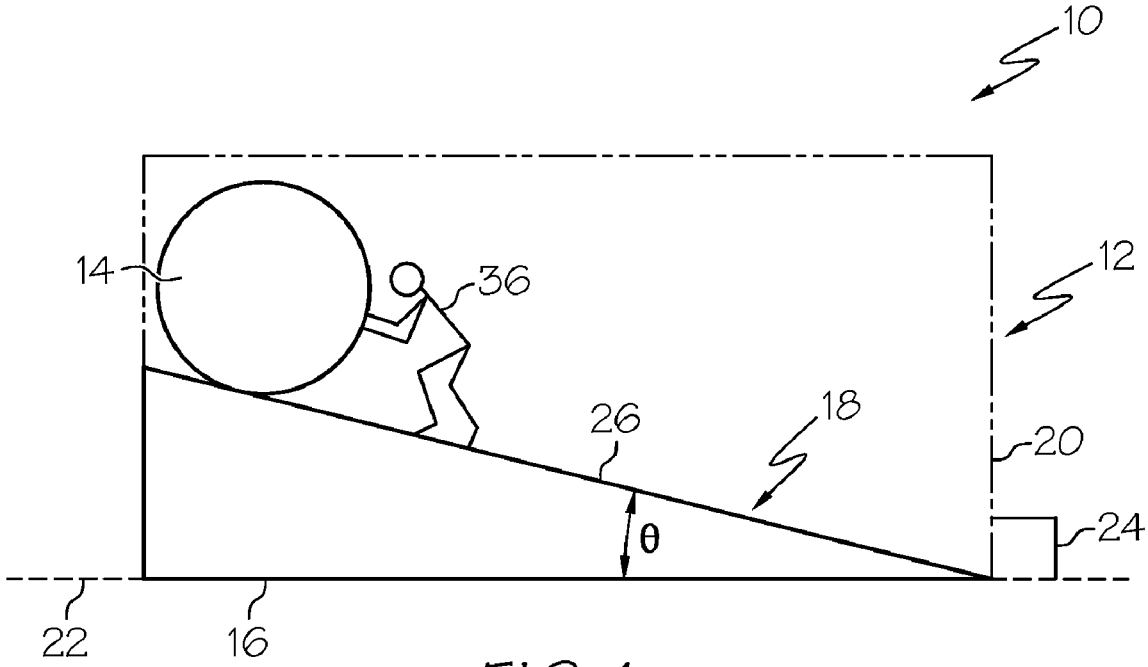
FIG. 1 is an illustration of a cross-sectional view of a fitness development system in accordance with one embodiment shown and described herein.

In one exemplary embodiment, shown in FIG. 1, the object 14 may be unrestrained in the interior of the exercise chamber 12 and, as such, the entire weight and potential energy of the object 14 created by the gravitational pull down the inclined floor 18 may be subjected against the individual 36 advancing the object 14 up the inclined floor 18. However, in another exemplary embodiment, as shown in FIG. 2, the object 14 may be tethered to one or more of the barriers 20 of the exercise chamber 12 such that the object 14 is at least partially restrained. Here, the fitness development system 10 further comprises one or more elastic or substantially inelastic tethers 34 that tether the object to one or more of the barriers of the exercise chamber 12. It is contemplated that the tethers 34 may be used to at least partially restrain the object 14, thereby preventing the object 14 from rolling freely down the inclined floor 18. For example, the tethers 34 may be secured to the end barrier above the inclined floor 18, as shown in FIG. 2. It is also contemplated, however, that the tethers 34 may be used to at least partially restrain the object from being advanced up the inclined floor 18, thereby providing further resistance to the individual 36 advancing the tethered object up the inclined floor 18. For example, elastic tethers 34 may be secured to the end barrier at the bottom of the inclined floor 18.

Embodiments shown and described herein relate to fitness development of an individual utilizing the fitness development system 10 described herein. In one exemplary embodiment, a method of developing fitness of an individual is provided, the method comprising advancing an object up an inclined floor. More particularly, the individual pushes the object up the inclined floor against a gravitational pull on the object down the inclined floor. The individual generally pushes the object up the inclined floor with an upper body portion of the individual and steps along the inclined floor with a lower body portion of the individual. The advancing of the object up the inclined floor develops fitness of both the upper and lower body portions of the individual. In addition, the advancing of the object up the inclined floor develops fitness of the individual through cardiovascular, strength, stamina, balance, and center of gravity training.

It is contemplated by the embodiments of the present application that the fitness development system 10 may be used by a variety of individuals seeking to develop fitness in one or more of a number of conditions, whether for power/strength building, to increase stamina, to improve upon balance and center of gravity, or to combine any of these conditions, or others, with a cardiovascular workout. For example, athletes, such as football offensive and defensive linemen, may find such fitness development provided by the system 10 and the method 40 beneficial to improving not only their fitness, but also their techniques used in competition. Also, such athletes may compete in the system 10 by dueling with the object 14 by advancing the object 14 without letting the object 14 or the athlete touch the barriers 20 of the chamber 12.

It is noted that recitations herein of a component of embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally" and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

The foregoing description of the various embodiments and principles of the present application has been presented for the purposes of illustration and description. It is not intended to be exhaustive or to limit the embodiments to the precise forms disclosed. Many alternatives, modifications, and variations will be apparent to those skilled in the art. Moreover, although multiple inventive concepts have been presented, such aspects need not be utilized in combination, and various combinations of the inventive aspects are possible in light of the various embodiments provided above. Accordingly, the above description is intended to embrace all possible alternatives, modifications, combinations, and variations that have been discussed or suggested herein, as well as all others that fall within the principles, spirit, and broad scope of the embodiments as defined by the claims.

What is claimed is:

1. An exercise chamber and an object, the exercise chamber comprising an inclined floor, a control unit, and one or more barriers, wherein:

the inclined floor is bidirectionally adjustable such that an angle of inclination of the inclined floor is bidirectionally adjustable from more than 0 degrees to less than 90 degrees, wherein the angle of inclination maximizes fitness development of an individual advancing the object up the inclined floor, and wherein the inclined floor further comprises a tactile surface to provide additional friction between the inclined floor and the individual advancing the object up the inclined floor, wherein the individual can be positioned on top of the tactile surface the control unit is operable to control bidirectional adjustment of the inclined floor; and the barriers substantially enclose the exercise chamber; and the object comprises a diameter from about 3 feet to about 7 feet.

2. The fitness development system of claim 1, wherein the angle of inclination of the inclined floor is about 14 degrees.

3. The fitness development system of claim 1, wherein the inclined floor provides a substantially planar surface that rises along the angle of inclination to a maximum height over a length of the exercise chamber.

4. The fitness development system of claim 1, wherein the inclined floor provides a sloped surface that rises along the angle of inclination to a maximum height over a length of the exercise chamber.

5. The fitness development system of claim 1, wherein the inclined floor provides a stepped surface that rises along the angle of inclination to a maximum height over a length of the exercise chamber.

6. The fitness development system of claim 1, wherein a coefficient of friction between the tactile surface and a foot or shoe of the individual advancing the object up the inclined floor is from about 0.02 to about 0.50.

7. The fitness development system of claim 1, wherein the tactile surface of the inclined floor has a thickness of about 0.50 inches.

8. The fitness development system of claim 1, wherein the inclined floor further comprises a material disposed between the tactile surface and the inclined floor.

9. The fitness development system of claim 1, wherein the barriers of the exercise chamber are padded.

10. The fitness development system of claim 1, wherein one or more of the barriers of the exercise chamber are substantially entirely transparent.

11. The fitness development system of claim 1, wherein the object is spherical in shape.

12. The fitness development system of claim 1, wherein the object is configured such that the weight of the object is variable.

13. The fitness development system of claim 1, wherein the object is tethered to one or more of the barriers of the exercise chamber.

14. The fitness development system of claim 13, wherein the fitness development system further comprises one or more elastic or substantially inelastic tethers that tether the object to one or more of the barriers of the exercise chamber.

15. The fitness development system of claim 1, wherein the exercise chamber further comprises a video-recording system, an audio system, or both.

16. The fitness development system of claim 1, wherein the object comprises a fixed weight.

17. The fitness development system of claim 1, wherein the object comprises a rigid exterior surface and an interior bladder at least partially filled with at least one of water and another fluid.

18. The fitness development system of claim 17, wherein the object is configured such that the amount of the at least one of water and another fluid at least partially filling the interior bladder is variable.

* * * * *